US007731046B2

(12) United States Patent
Johnson

(10) Patent No.: US 7,731,046 B2
(45) Date of Patent: Jun. 8, 2010

(54) COMPOSITE SANDWICH PANEL AND METHOD OF MAKING SAME

(75) Inventor: David W. Johnson, San Diego, CA (US)

(73) Assignee: Ebert Composites Corporation, Chula Vista, CA (US)

( * ) Notice: Subject to any disclaimer, the term of this patent is extended or adjusted under 35 U.S.C. 154(b) by 137 days.

(21) Appl. No.: 11/780,392

(22) Filed: Jul. 19, 2007

(65) Prior Publication Data

US 2008/0145592 A1 Jun. 19, 2008

Related U.S. Application Data

(63) Continuation-in-part of application No. 11/745,350, filed on May 7, 2007, and a continuation of application No. 10/744,630, filed on Dec. 23, 2003, now Pat. No. 7,217,453, and a continuation of application No. 10/059,956, filed on Nov. 19, 2001, now Pat. No. 6,676,785.

(60) Provisional application No. 60/298,523, filed on Jun. 15, 2001, provisional application No. 60/281,838, filed on Apr. 6, 2001.

(51) Int. Cl.

| | |
|---|---|
| ***B32B 27/04*** | (2006.01) |
| ***B65D 1/42*** | (2006.01) |
| ***B65D 6/14*** | (2006.01) |
| ***B65D 8/04*** | (2006.01) |

(52) U.S. Cl. ..... 220/62.15; 220/1.5; 428/292.1

(58) Field of Classification Search ..... 220/1.5, 220/62.15, 645; 428/73, 292.1, 298.1; 52/794.1; 156/93

See application file for complete search history.

(56) References Cited

U.S. PATENT DOCUMENTS

| | | | |
|---|---|---|---|
| 2,762,739 | A | 9/1956 | Weiss |
| 2,954,001 | A | 9/1960 | Luxenburg |
| 3,211,115 | A | 10/1965 | Burillon et al. |

(Continued)

FOREIGN PATENT DOCUMENTS

| | | | |
|---|---|---|---|
| DE | 4342575 | A1 | 4/1995 |

(Continued)

OTHER PUBLICATIONS

International Search Report/Written Opinion issued in PCT/US07/74080 on Jul. 22, 2008.

(Continued)

*Primary Examiner*—Anthony Stashick
*Assistant Examiner*—Harry A Grosso
(74) *Attorney, Agent, or Firm*—Stephen C. Beuerle; Procopio, Cory, Hargreaves & Savitch LLP

(57) ABSTRACT

A method of manufacturing a composite panel includes manufacturing a composite panel having a first skin, a second skin, a core, and a plurality of distinct groupings of Z-axis fibers that extend through the core from the first skin to the second skin, wherein the Z-axis fibers include opposite ends respectively terminating at and integrated into the first skin and the second skin; and creating structural stringers in the composite panel by removing the second skin and substantially all of the core and the Z-axis fibers down to or adjacent to the first skin.

17 Claims, 8 Drawing Sheets

U.S. PATENT DOCUMENTS

| | | | |
|---|---|---|---|
| 3,230,995 | A | 1/1966 | Shannon |
| 3,241,508 | A | 3/1966 | Chezaud et al. |
| 3,328,218 | A | 6/1967 | Noyes |
| 3,647,606 | A | 3/1972 | Notaro |
| 3,761,345 | A | 9/1973 | Smith |
| 3,833,695 | A | 9/1974 | Vidal |
| 3,837,985 | A | 9/1974 | Chase |
| 3,870,580 | A | 3/1975 | Belcher |
| 3,948,194 | A | 4/1976 | Gunold |
| 3,993,523 | A | 11/1976 | Hunt et al. |
| 4,032,383 | A | 6/1977 | Goldsworthy et al. |
| 4,059,468 | A | 11/1977 | Bouillon |
| 4,077,340 | A | 3/1978 | Braum et al. |
| 4,080,915 | A | 3/1978 | Bompard et al. |
| 4,196,251 | A | 4/1980 | Windecker |
| 4,206,895 | A | 6/1980 | Olez |
| 4,218,276 | A | 8/1980 | King |
| 4,256,790 | A | 3/1981 | Lackman et al. |
| 4,291,081 | A | 9/1981 | Olez |
| 4,299,871 | A | 11/1981 | Forsch |
| 4,331,091 | A | 5/1982 | Parker et al. |
| 4,335,176 | A | 6/1982 | Baumann |
| 4,495,231 | A | 1/1985 | Laskaris et al. |
| 4,495,235 | A | 1/1985 | Tesch |
| 4,498,941 | A | 2/1985 | Goldsworthy |
| 4,506,611 | A | 3/1985 | Parker et al. |
| 4,528,051 | A | 7/1985 | Heinze et al. |
| 4,541,349 | A | 9/1985 | Inoue |
| 4,628,846 | A | 12/1986 | Vives |
| 4,752,513 | A | 6/1988 | Rau et al. |
| 4,808,461 | A | 2/1989 | Boyce et al. |
| 4,854,250 | A | 8/1989 | Stuvecke et al. |
| 4,913,937 | A | 4/1990 | Engdahl et al. |
| 4,917,756 | A | 4/1990 | Cahuzac et al. |
| 4,955,123 | A | 9/1990 | Lawton et al. |
| 4,963,408 | A | 10/1990 | Huegli |
| 4,983,453 | A | 1/1991 | Beall |
| 5,055,242 | A | 10/1991 | Vane |
| 5,095,833 | A | 3/1992 | Darrieux |
| 5,186,776 | A | 2/1993 | Boyce et al. |
| 5,286,320 | A | 2/1994 | McGrath et al. |
| 5,314,282 | A | 5/1994 | Murphy et al. |
| 5,324,377 | A | 6/1994 | Davies |
| 5,327,621 | A | 7/1994 | Yasui et al. |
| 5,333,562 | A | 8/1994 | LeMaire et al. |
| 5,361,483 | A | 11/1994 | Rainville et al. |
| 5,373,796 | A | 12/1994 | Besemann |
| 5,429,853 | A | 7/1995 | Darrieux |
| 5,445,693 | A | 8/1995 | Vane |
| 5,445,860 | A | 8/1995 | Bova |
| 5,445,861 | A | 8/1995 | Newton et al. |
| 5,466,506 | A | 11/1995 | Freitas et al. |
| 5,490,602 | A | 2/1996 | Wilson et al. |
| 5,549,771 | A | 8/1996 | Brooker |
| 5,580,514 | A | 12/1996 | Farley |
| 5,589,015 | A | 12/1996 | Fusco et al. |
| 5,589,243 | A | 12/1996 | Day |
| 5,624,622 | A | 4/1997 | Boyce et al. |
| 5,632,844 | A | 5/1997 | Pate et al. |
| 5,639,410 | A | 6/1997 | Amaike et al. |
| 5,642,679 | A | 7/1997 | Monget et al. |
| 5,667,859 | A | 9/1997 | Boyce et al. |
| 5,681,408 | A | 10/1997 | Pate et al. |
| 5,736,222 | A | 4/1998 | Childress |
| 5,741,574 | A | 4/1998 | Boyce et al. |
| 5,759,321 | A | 6/1998 | Cahuzac |
| 5,770,155 | A | 6/1998 | Dunphy et al. |
| 5,778,806 | A | 7/1998 | Badillo |
| 5,789,061 | A | 8/1998 | Campbell et al. |
| 5,809,805 | A | 9/1998 | Palmer et al. |
| 5,827,383 | A | 10/1998 | Campbell et al. |
| 5,829,373 | A | 11/1998 | Baxter |
| 5,832,594 | A | 11/1998 | Avila |
| 5,834,082 | A | 11/1998 | Day |
| 5,862,975 | A | 1/1999 | Childress |
| 5,863,635 | A | 1/1999 | Childress |
| 5,868,886 | A | 2/1999 | Alson et al. |
| 5,869,165 | A | 2/1999 | Rorabaugh et al. |
| 5,873,973 | A | 2/1999 | Koon et al. |
| 5,876,540 | A | 3/1999 | Pannell |
| 5,876,652 | A | 3/1999 | Rorabaugh et al. |
| 5,876,832 | A | 3/1999 | Pannell |
| 5,882,756 | A | 3/1999 | Alston et al. |
| 5,882,765 | A | 3/1999 | Pastureau et al. |
| 5,916,469 | A | 6/1999 | Scoles et al. |
| 5,919,413 | A | 7/1999 | Avila |
| 5,935,475 | A | 8/1999 | Scoles et al. |
| 6,051,089 | A | 4/2000 | Palmer et al. |
| 6,090,465 | A | 7/2000 | Steele et al. |
| 6,106,646 | A | 8/2000 | Fairbanks |
| 6,117,260 | A | 9/2000 | Rossi |
| 6,128,998 | A | 10/2000 | Freitas et al. |
| 6,132,859 | A | 10/2000 | Wainwright |
| 6,139,942 | A | 10/2000 | Hartness et al. |
| 6,151,439 | A | 11/2000 | Wainwright |
| 6,187,411 | B1 | 2/2001 | Palmer |
| 6,190,602 | B1 | 2/2001 | Blaney et al. |
| 6,196,145 | B1 | 3/2001 | Burgess |
| 6,291,049 | B1 | 9/2001 | Kunkel et al. |
| 6,454,112 | B1 * | 9/2002 | Walters et al. ..... 220/1.5 |
| 6,454,889 | B1 | 9/2002 | Hendrix et al. |
| 6,632,309 | B1 | 10/2003 | Hendrix et al. |
| 6,645,333 | B2 | 11/2003 | Johnson et al. |
| 6,808,142 | B2 | 10/2004 | Oki |
| 2002/0014302 | A1 | 2/2002 | Fanucci et al. |
| 2002/0069503 | A1 | 6/2002 | Sentmanat |
| 2002/0144676 | A1 | 10/2002 | Johnson et al. |
| 2002/0153084 | A1 | 10/2002 | Johnson et al. |
| 2005/0074593 | A1 | 4/2005 | Day et al. |

FOREIGN PATENT DOCUMENTS

| | | |
|---|---|---|
| GB | 1275705 | 6/1970 |
| GB | 2245862 | 1/1992 |
| JP | 5-200884 A | 10/1993 |
| JP | -63-60738 | 3/1998 |
| WO | WO 92/00845 A1 | 1/1992 |
| WO | WO 98/08271 | 2/1998 |
| WO | WO 98/08271 A1 | 2/1998 |
| WO | WO 03/011576 | 2/2003 |

OTHER PUBLICATIONS

Stanley et al., "Development and Evaluation of Stitched Sandwich Panels", NASA-CR 2001-211025, Jun. 2001.

Martin, et al. "Ultrusion," Engineering Materials Handbook, vol. 1, Composites, ASM International, 1989, pp. 533-543.

Gabriele, M., "Pultrusion's Promise," Plastics Technology, Mar. 1995, pp. 36-40.

* cited by examiner

COMPOSITE SANDWICH PANEL AND METHOD OF MAKING SAME

CROSS REFERENCE TO RELATED APPLICATIONS

This application is a continuation-in-part of U.S. patent application Ser. No. 11/745,350 filed May 7, 2007, which is a continuation of U.S. patent application Ser. No. 10/744,630 filed Dec. 23, 2003, which issued as U.S. Pat. No. 7,217,453 on May 15, 2007, which is a continuation of U.S. patent application Ser. No. 10/059,956 filed Nov. 19, 2001, which issued as U.S. Pat. No. 6,676,785 on Jan. 13, 2004, which claims the benefit of provisional patent application No. 60/298,523 filed on Jun. 15, 2001, provisional patent application No. 60/281,838 filed on Apr. 6, 2001 and provisional patent application No. 60/293,939 filed on May 29, 2001. This application also claims the benefit of prior provisional patent application No. 60/820,380 filed Jul. 26, 2006 under 35 U.S.C. 119(e). All of the above applications/patents are incorporated by reference herein as though set forth in full.

FIELD OF THE INVENTION

The present invention relates to composite sandwich panels and methods of manufacturing the same.

BACKGROUND OF THE INVENTION

The current high priced fossil-fuel market for all segments of the transportation industry has made weight reduction in sea-borne, land-borne, and air-borne transportation vehicles of utmost importance. Weight reduction in these transportation vehicles translates into fuel savings, especially over time.

SUMMARY OF THE INVENTION

The current invention relates to a new and improved composite sandwich panel that is designed to be fabricated in a two-step process. The objective of this higher manufacturing cost process (i.e., the two-step process) is to provide little or no compromise on structural performance, but a dramatic improvement in panel weight. This extra manufacturing cost related to the second step of the two-step process is very practical in the current high priced fossil-fuel market for all segments of the transportation industry. That practicality results from the very value of reduced weight and how it reduces fuel consumption, when applied to the core structure of all transportation products, whether sea-borne, land-borne, or air-borne. All segments of the transportation industry are willing to pay an extra price for weight reduction, because there will be a payback of any premium costs as a result of eventual operations wherein fuel will be saved.

An aspect of the invention involves a method of manufacturing a composite panel. The method includes manufacturing a composite panel having a first skin, a second skin, a core, and a plurality of distinct groupings of Z-axis fibers that extend through the core from the first skin to the second skin, wherein the Z-axis fibers include opposite ends respectively terminating at and integrated into the first skin and the second skin; and creating structural stringers in the composite panel by removing the second skin and substantially all of the core and the Z-axis fibers down to or adjacent to the first skin.

Another aspect of the invention involves a composite panel including a first skin; and a plurality of distinct groupings of Z-axis fibers including an end terminating at and integrated into the first skin, wherein the plurality of distinct groupings of Z-axis fibers form structural stringers and recesses in the composite panel.

A further aspect of the invention involves an air cargo container for carrying cargo in the lower deck or upper deck of a wide-bodied airplane. The air cargo container includes a floor, a top; and a plurality of wall panels joining the floor and the top. One or more of the top, the floor and the wall panels include a first skin; and a plurality of distinct groupings of Z-axis fibers including an end terminating at and integrated into the first skin, wherein the plurality of distinct groupings of Z-axis fibers form structural stringers and recesses.

BRIEF DESCRIPTION OF DRAWINGS

The accompanying drawings, which are incorporated in and form a part of this specification, illustrate embodiments of the invention and together with the description, serve to explain the principles of this invention.

DESCRIPTION OF EMBODIMENT OF INVENTION

With reference to FIGS. 1-22, an embodiment of an improved composite sandwich panel and method of making the same will be described. The improved composite sandwich panel is fabricated in a two-step process. The first step of the manufacturing process involves manufacturing a new sandwich panel of 3D-fibers deposited and integrated into skins of the sandwich. This construction eliminates skin delamination, a common failure mode in composite sandwich panels. This first step will be described initially below with respect to FIGS. 1-20. The second step of the manufacturing process includes a machining operation performed on one side of the 3D-fiber sandwich panel. This second step will be described further below with respect to FIGS. 21 and 22.

First Step—Manufacturing a New Sandwich Panel of 3D-Fibers Deposited and Integrated into Skins of the Sandwich With reference to FIGS. 1-20, and initially FIG. 1, the first step of manufacturing a new sandwich panel of 3D-fibers deposited and integrated into skins of the sandwich will be described.

The step of manufacturing a new sandwich panel of 3D-fibers deposited and integrated into skins of the sandwich includes inserting z-axis reinforcing fibers into a composite laminate.

Figure 1:
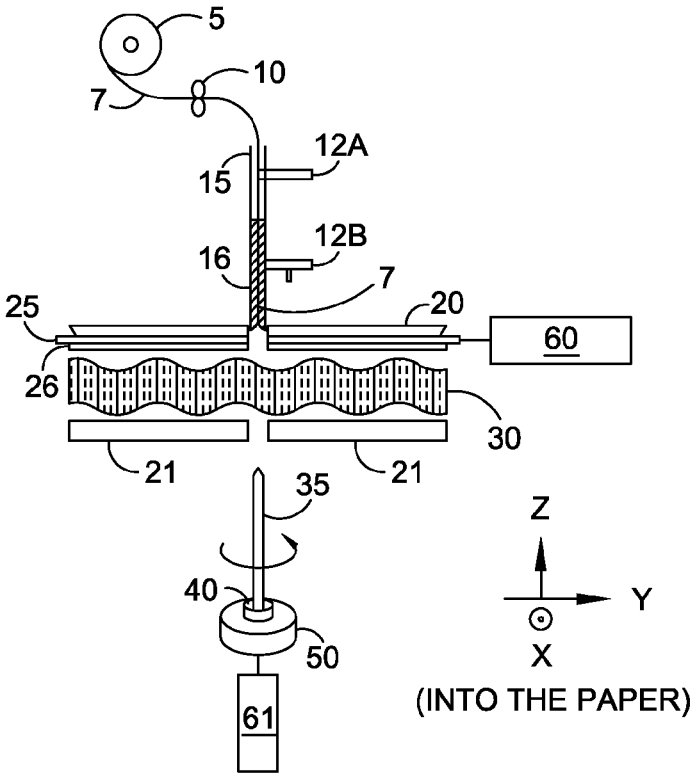
FIG. 1 is a schematic side elevation view of a z-axis fiber deposition unit.

FIG. 1 shows a schematic elevation view of the novel z-axis fiber deposition process and the associated machinery for this first step. Although only one z-axis fiber deposition unit is illustrated in this figure, in practice, multiple z-axis fiber deposition components would typically be used in this step.

In FIG. 1, the cross section of a typical x-y axis material is defined by numeral 30. Material 30 is a continuously traveling laminate of x-y material. The direction of pultrusion and the continuous processing is defined as being in the x-axis direction and is into the paper. The y-axis direction is left-to-right along 3-D material 30. The z-axis direction is from top-to-bottom, through 3-D material 30. Only a few layers, or "plies" of x-y axis material 30 is shown, although clearly, multiple layers could be shown. A single layer of material 30 is made up of x-axis material and y-axis material, produced by other processes prior to incorporation into the z-axis fiber deposition process. This x-y axis material could be woven glass fiber or stitched glass fiber or a combination of each, or it could be mat or unidirectional roving, or could be other fiber such as carbon or aramid.

Material 30 is contained in the z-axis direction by a chamber in the housing shown only by the top and bottom plates 20 and 21 respectfully. The side plates of the housing, not shown, restrict the edges of material 30. Since there are multiple z-axis deposition points along the y-axis, and since FIG. 1 shows only one of these points, the edges of the chamber in the containment housing and the x-y axis material are not shown. Plates 20 and 21 are pre-spaced such that a very compact set of layers 30 are drawn through the housing, compressing the x-y axis material 30 to its nearly final z-axis directional compression prior to receiving the z-axis fiber or entering the pultrusion die. Material 30 may be impregnated with resin material and if thermoset, may be debulked prior to entering the chamber in the containment housing defined by plates 20 and 21.

As stated earlier, material 30 could also be sandwich structure, without changing the operation or process. As shown in FIG. 1, the material 30 is a stack of layers of x-y axis fiber material, which, after deposition of the z-axis directional fiber, will be processed into the quasi-isotropic bar stock. If the material 30, is 1 inch thick (for example) there might be 36 layers of x-y axis material making up the 1-inch thickness. It would be a simple matter of construction to substitute for the middle layers of x-y axis material, a core material 28, such as foam plastic, honeycomb material, or balsa wood. These core materials are low density and are used in sandwich structure construction. In this manner, for example, but not by way of limitation, material 30 could have six layers of x-y axis material on the top, a core material of 0.75 inches in thickness and six layers of x-y axis material on the bottom. The z-axis fiber deposition method described herein would be identical, whether the material 30 was 100% x-y axis fiber material or a sandwich material having a core and top 27 and bottom 29 "skin" material.

The key elements of the z-axis fiber deposition mechanism are shown in FIG. 1, although all of the details of how certain mechanisms are supported or actuated are not shown. The first step of the process has the material 30 being drawn into the chamber in the containment housing between upper and lower surfaces 20 and 21, respectfully. Material 30 is stopped because the machinery moves synchronously to the pultrusion speed. This allows the "pathway deposition probe" (PDP) 35 to be inserted through the material 30. Alternatively, the material could be moving continuously and the deposition process could be gantry and synchronous with the pultrusion speed. The PDP 35 is an elongated solid rod having a tapered front tip, a shank portion, and a rear end. PDP 35 is first rotated by a motor 50 and then actuated upwardly by way of an actuator 61.

Then the process begins in which a fiber bundle, shown by the single line 7, is deposited in the stack of x-y axis material 30. Although the fiber bundle 7 is shown as a single line, in fact it could be a glass, carbon, or other fiber bundle containing hundreds or even thousands of continuous fiber filaments. This process will be referred to as the z-axis fiber deposition process. The z-axis fiber bundle 7 is contained on a stationary roll 5 which is free to be drawn continuously from the roll 5. The fiber bundle is fed through a guidance bushing 10 and through two tubes, one of which is stationary outer tube 15 and the other a movable tube 16. Stationary outer tube 15 and movable inner tube 16 are concentric with very close tolerances and are both penetrated at two locations to accept a fiber clamp 12A and a fiber clamp 12B. Fiber clamp 12A is by definition, stationary, as it penetrates the stationary outer tube 15. Fiber clamp 12B is by definition, movable, as it must move with the movement of the mechanism in the z-axis direction of the moveable inner tube 16. Moveable fiber clamp 12B may or may not be extended when tube 16 is moving. The actuation mechanism of clamp 12B is independent of the actuation mechanism for tube 16, both of which are shown in FIG. 1 for clarity. The purpose of fiber clamps 12A and 12B is to provide positive clamping of the fiber bundle to the interior of tubes 15 and 16, respectively, at different times and for different purposes.

Once the PDP 35 has rotated, has been actuated in the z-axis direction, and has fully penetrated the x-y axis fiber layers 30, the PDP 35 is not yet touching the outer movable tube 16, but has passed completely through material 30. At this time the PDP 35 is stopped rotating.

As mentioned previously, the rotation of PDP 35 assists in the penetration of material 30 with minimum force and minimum fiber damage in the x-y axis material 30. The next step in the process is as follows: fiber camp 12A is unclamped and fiber clamp 12B is clamped. By actuating fiber clamp 12B, in the clamped location, fiber bundle 7 is secured to the inner wall of moveable tube 16 and allows fiber bundle 7 to move with tube 16.

Once clamp 12B has secured the fiber bundle 7 to movable inner tube 16, a mechanism (not shown) moves inner tube 16 downward in the z-axis direction until the bottom end of the tube 16 makes contact with the outside of the PDP 35 (which has already penetrated the x-y axis material 30) but at this time is not rotating.

Next, the mechanism that moves inner tube 16, moves fiber bundle 7 and the PDP 35 through the entire x-y axis material 30. PDP 35 had created a pathway for inner tube 16 to be inserted through material 30. A certain amount of low actuation force on the PDP 35 insures that the inner tube 16 stays intimate and in contact with the PDP 35. This technique insures a smooth entry of tube 16 and the clamped fiber bundle 7 through the x-y axis material 30. Fiber bundle 7 is pulled off the spool 5 by this process.

Next fiber clamp 12B is released into the unclamped position and fiber clamp 12A is actuated into a clamped position. In this way, fiber clamp 12A secures fiber bundle 7 against the interior wall of stationary tube 15. This ensures that the fiber bundle 7 remains stationary and deposited in the x-y axis material 30. Following this, moveable inner tube 16 is withdrawn from the x-y axis material 30 and actuated upwardly in the z-axis direction back to the original position shown in FIG. 1. When this step is done fiber bundle 7 does not move. Fiber bundle 7 remains as a fully deposited fiber bundle in the z-axis direction. Next, fiber bundle 7 is sheared off at the Top of the x-y axis material 30 by a shear plate 25 and 26. The stationary part of shear plate 26 never moves. The movable portion 25 is actuated by an actuator 60. This cuts fiber bundle 7, much like a scissors cut, and allows the fiber bundle 7, continuous to spool 5, to be separated from the z-axis fiber deposited bundle. This allows a preparation for the second z-axis fiber deposition. The preparation includes adjusting the end of the fiber bundle 7 relative to the end of moveable inner plate 16. As shown in FIG. 1, the end of fiber bundle 7 is drawn slightly inwardly from the bottom end of the tube 16. This is necessary to allow the point on the tip of PDP 35 to enter tube 16 as the next cycle without fiber being caught between the contact points of inner tube 16 and PDP 35. This is accomplished as follows: Once sheer plate 25 has cut the deposited z-axis fiber from fiber bundle 7, the end of fiber bundle 7 is slightly extended below the inner tube 16. Next, fiber clamp 12A is released and fiber clamp 12B is actuated and clamped. Inner tube 16 is actuated further upward in the z-axis direction as shown in FIG. 1 until the end of fiber bundle 7 is in the same relative position as that shown in FIG. 1. Next, clamp 12A is actuated and clamped and clamp 12B is released, unclamped. Following this, inner tube 16 is moved downward in the z-axis direction to the position shown in FIG. 1, thus that the relative position of the end of moveable inner tube 16 and the end of fiber bundle 7 is as shown in FIG. 1. The cycle is now set to be repeated.

All of the previously described operation can occur rapidly. Several units of the device as illustrated in FIG. 1 are installed side-by-side. The movement of an entire housing containing all of the devices of FIG. 1, occurs with the x-y axis material 30 and the plates 25 and 26 remaining stationary. In this way, for example, while the material 30 is stopped, an extra z-axis fiber can be deposited between the locations of two z-axis fibers deposited on the first cycle. A high number of z-axis fiber bundles in one row, with material 30 stationary, can in fact be deposited. Once a row which is defined as the deposited z-axis fibers lineal in the y direction, is completed, material 30 can be moved relative to the machinery of FIG. 1 and a second row of z-axis fibers can be deposited. This new row can have the same pattern or a staggered pattern, as required.

One other device in FIG. 1 requires mentioning. Spring 40, located at the base PDP 35 and between the PDP and the motor 50 has a special purpose. When inner tube 16 contacts PDP 35, and then subsequently pushes PDP 35 back through the layers of x-y axis material 30, a flaring in the end of the tube can occur, if the relative force between the two exceeds a certain value. The flaring of the tube end 16 will result in failure of the mechanism. Spring 40 prevents this excess differential force, thus resulting in no flaring of the end of tube 16.

Figure 2:
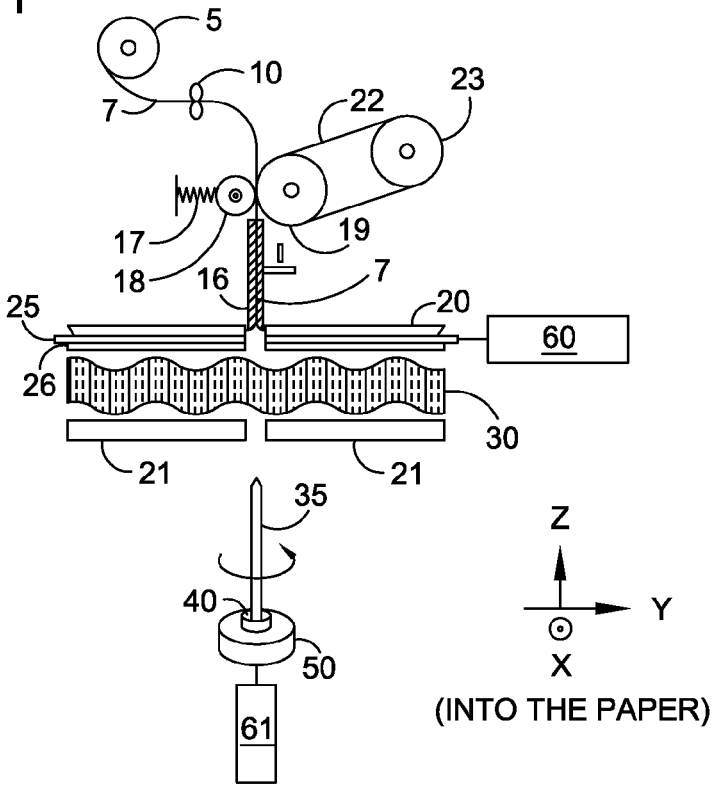
FIG. 2 is a schematic side elevation view of a first alternative embodiment of the z-axis fiber deposition unit.

In an alternative embodiment, the feed mechanism described in FIG. 1 and depicted by clamps 12A and 12B, and the outer tube 15 and inner tube 16, is replaced by the mechanism illustrated in FIG. 2. This mechanism requires a more sophisticated motion control than the clamp system of FIG. 1, as will be evident in the description below.

The components of FIG. 2 replace the components of FIG. 1 that are shown above the carrier plate 20. The key new components are a tube 16, a urethane wheel 19, an idler bearing 18, a spring 17, a drive belt 22 and a CNC type motion control motor 23. All of these components are intimately connected to a frame (not shown), which is driven through carrier plates 20 and 21, by a CNC-type motor and ball screw (also not shown). In this way, all of the components 16, 19, 18, 17, 22 and 23 move together as a synchronous unit.

The embodiment illustrated in FIG. 2 has the same fiber roll 5, fiber tow or bundle 7, and guidance bushing 10. Idler bearing 18 and urethane wheel 19 provide a positive clamping of the fiber bundle 7. Spring 17, assures a side force of known quantity and clamps the fiber bundle 7. When motion control motor 23 is in a locked position, not rotated, fiber bundle 7 is clamped and cannot be moved. When motor 23 is rotated, fiber bundle 7 moves relative to tube 16, since the position of tube 16 is always the same as the other components 19, 18, 17, 22 and 23 of FIG. 2. In this way, fiber bundle 7 can either be clamped so that it can not move inside tube 16 or it can be moved inside tube 16 by rotation of the motion control motor 23.

It should now be apparent that the mechanisms illustrated in FIG. 2 can substitute for those identified in FIG. 1. When tube 16, with fiber bundle 7 clamped, is moved by a CNC motor (not shown) through the x-y material 30, motor 23 is not rotated. However, when tube 16 is drawn from the x-y axis material 30, motor 23 is rotated at the exact rate of speed as the withdraw of PDP 35. This can be accomplished with present day sophisticated motion control hardware and software. In doing this, fiber bundle 7 stays stationary relative to x-y axis material 30 even though tube 16 is being withdrawn.

The advantage of the mechanisms in FIG. 2, although they provide identical functions to their counterparts in FIG. 1, is that the speed of the process can improve by eliminating the alternative clamping of clamps 12A and 12B. Nevertheless, either set of mechanisms is viable for the disclosed invention.

Although the insertion mechanisms shown in FIGS. 1 and 2 show insertion perpendicular to a plane defined by the composite sandwich structure, in alterative embodiments, the insertion is oriented at any angle (e.g., 45 degrees) relative to the plane defined by the composite sandwich structure.

Figure 3:
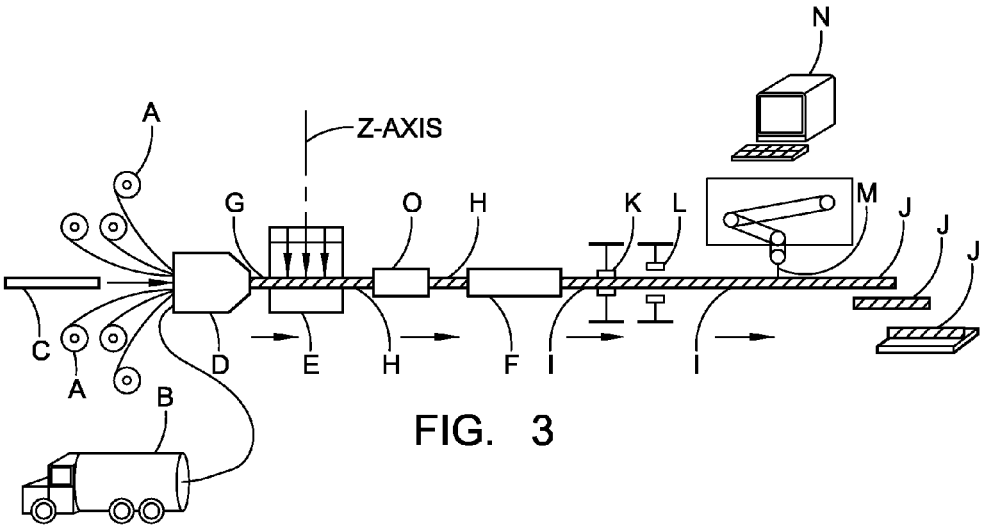
FIG. 3 is a schematic illustration of a method and apparatus for forming continuously and automatically a 3-D Z-axis reinforced composite laminate structure.

With reference to FIGS. 3-20, and initially FIG. 3, the first step of manufacturing a new sandwich panel of 3D-fibers deposited and integrated into skins of the sandwich, and especially the pultrusion and clinching aspects of the first step, will be further described.

FIG. 3 illustrates an embodiment of the overall first step of manufacturing a new sandwich panel of 3D-fibers deposited and integrated into skins of the sandwich. The pultrusion direction is from left-to-right in FIG. 3 as shown by the arrows.

Shown in FIG. 3 are grippers K and L. These are typically hydraulically actuated devices that can grip a completely cured composite laminate panel I as it exits pultrusion die F. These grippers K, L operate in a hand-over-hand method. When gripper K is clamped to the panel I, it moves a programmed speed in the direction of the pultrusion, pulling the cured panel I from the die F. Gripper L waits until the gripper K has completed its full stroke and then takes over.

Upstream of these grippers K, L, the raw materials are pulled into the die in the following manner. It should be recognized that all of the raw material is virgin material as it arrives from various manufacturers at the far left of FIG. 3. The fiber A can be glass fiber, either in roving rolls with continuous strand mat or it can be fabric such as x-y stitched fabric or woven roving. Besides glass, it can be carbon or aramid or other reinforcing fiber. A core material C is fed into the initial forming of the sandwich preform. The skins of the sandwich will be formed from the layers of fiber A on both the top and bottom of the sandwich preform G. The core C will be the central section of the sandwich. The core C can be made of urethane or PVC foam, or other similar foams in densities from 2 lbs. per cubic foot to higher densities approaching 12 lbs. per cubic foot. Alternatively core C could be made of end-grain balsa wood having the properties of 6 lb. per cubic foot density to 16 lb. per cubic foot or other materials.

The raw materials are directed, automatically, in the process to a guidance system in which resin from a commercial source B is directed to a primary wet-out station within resin tank D. The wetted out preform G exits the resin tank D and its debulking station in a debulked condition, such that the thickness of the panel section G is very nearly the final thickness of the ultimate composite laminate. These panels can be any thickness from 0.25 inches to 4 inches, or more. The panels can be any width from 4 inches wide to 144 inches wide, or more. Preform G is then directed to the Z-axis fiber deposition machine E that provides the deposition of 3-D Z-axis groupings of fiber filaments. The details as to how Z-axis fiber deposition machine E functions is described above with respect to FIGS. 1 and 2. This system is computer controlled so that a wide variety of insertions can be made. Machine E can operate while stationary or can move synchronously with the gripper speed. Groupings of fiber filaments are installed automatically by this machine into the preform H that is then pulled from the Z-axis fiber deposition machine E. Preform H has been changed from the preform H by only the deposition of 3-D Z-axis groupings of fiber filaments, all of which are virgin filaments as they have arrived from the manufacturer, such as Owens Coming.

Modified preform H of FIG. 3 now automatically enters a secondary wet-out station O. Station O can be the primary wet-out, eliminating station D, as an alternative method. This station helps in the completion of the full resin wet-out of the composite laminate structure, including the 3-D Z-axis groupings of fiber filaments. Preform H then enters pultrusion die F mentioned earlier and, through heat, preform H is brought up in temperature sufficiently to cause catalyzation of the composite laminate panel. Exiting die F is the final cured panel section I which is now structurally strong enough to be gripped by the grippers K and L.

The sandwich structure of FIG. 3 can then be made any length practicable by handling and shipping requirements. Downstream of the grippers K and L, the preform I is actually being "pushed" into the downstream milling machine system, M and N. Here a multi-axis CNC machine (computer numerical control) moves on a gantry synchronous with the gripper pull speed, and can machine details into the composite laminate structure/panel on the fly. These can be boltholes, edge routing, milling, or cut-off. The machine M is the multi-axis head controlled by the computer N. After cut-off, the part J is removed for assembly or palletizing and shipping.

Figure 4:
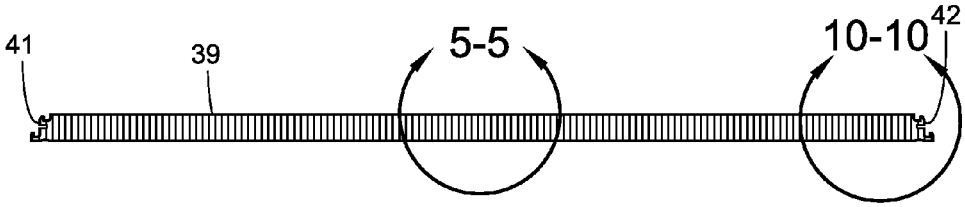
FIG. 4 is schematic vertical cross sectional view of an embodiment of a pultruded composite laminate panel, in which the clinched 3-D Z-axis fibers have been cured on the fly, showing side details. This embodiment of the panel would be used as a new lightweight matting surface for temporary military aircraft runway use.

FIG. 4 illustrates a vertical cross-section of one embodiment. It is a cross-section of a panel 39 that is 1.5 inches thick and 48 inches wide and to be used as a temporary runway, taxiway, or ramp for military aircraft. In remote locations, airfields must be erected quickly and be lightweight for transporting by air and handling. Panel 39 of FIG. 4 achieves these goals. Because it has been reinforced with the Z-axis groupings of fiber filaments, the panel can withstand the weight of aircraft tires, as well as heavy machinery. Since panel 39 is lightweight, at approximately 3 lbs. per square foot, it achieves a goal for the military, in terms of transportation and handling. Because 39 is pultruded automatically by the process illustrated in FIG. 3, it can be produced at an affordable price for the military. Also shown in FIG. 4 are edge connections, 41 and 42. These are identical but reversed. These allow the runway panels 39 also known as matting, to be connected and locked in place. Clearly, other applications for these composite structures exist beyond this one embodiment.

Figure 5:
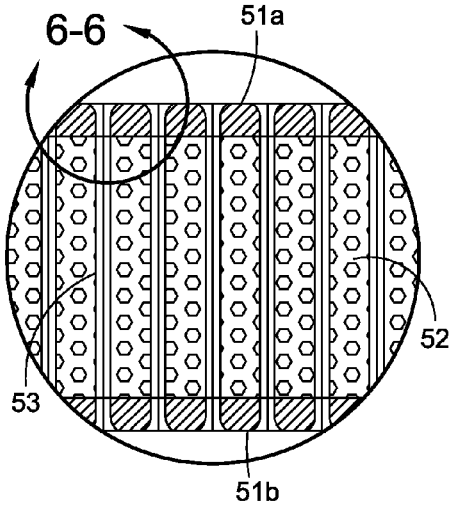
FIG. 5 is a magnified view taken along lines 5-5 of FIG. 4.
Figure 6:
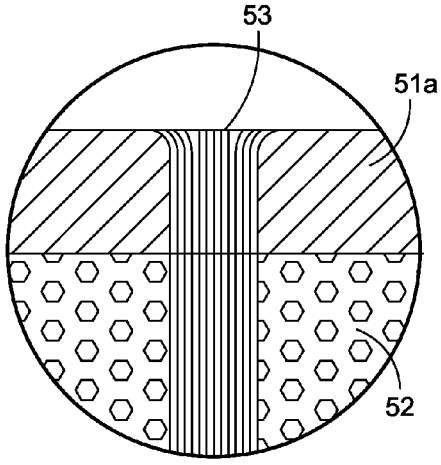
FIG. 6 is a magnified view taken along lines 6-6 of FIG. 5.

FIG. 5 is a magnified view taken along lines 5-5 of FIG. 4. FIG. 5 shows the cross section of the composite laminate structure, including the upper and lower skins 51*a* and 51*b*, respectfully. Core 52, which is shown as foam, clearly could be other core material such as, but not limited to, end-grain balsa wood. Also shown are the several 3-D Z-axis groupings of fiber filaments 53, which are spaced in this embodiment every 0.25 inches apart and are approximately 0.080 inches in diameter. It can be seen from FIG. 5 that the groupings of fiber filaments 53 are clinched, or riveted to the outside of the skins, 51*a* and 51*b*. FIG. 6 is a magnified view taken along lines 6-6 of FIG. 5. FIG. 6 shows core material 52 and the upper skin section 51*a* and lower skin section 51*b*. These skin sections are approximately 0.125 inches thick in this embodiment and consist of 6 layers of X-Y stitched glass material at 24 oz. per square yard weight. The Z-axis groupings of fiber filaments 53 can be clearly seen in FIG. 6. The clinching or riveting of these filaments, which lock the skin and core together, can clearly be seen.

Figure 7:
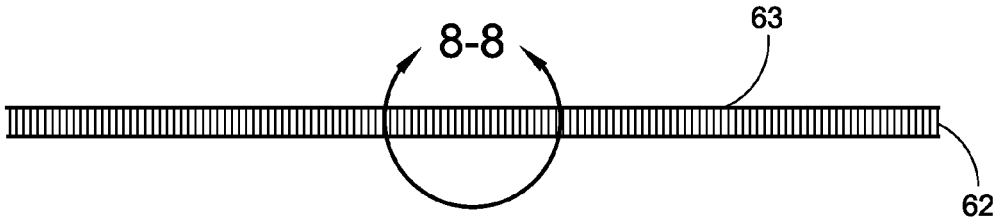
FIG. 7 is a schematic vertical cross-sectional view of the pultruded sandwich panel of the preferred embodiment, just prior to entering the pultrusion die, wherein the 3D Z-axis groupings of fiber filaments have been deposited and they are prepared for clinching and riveting in the die.
Figure 8:
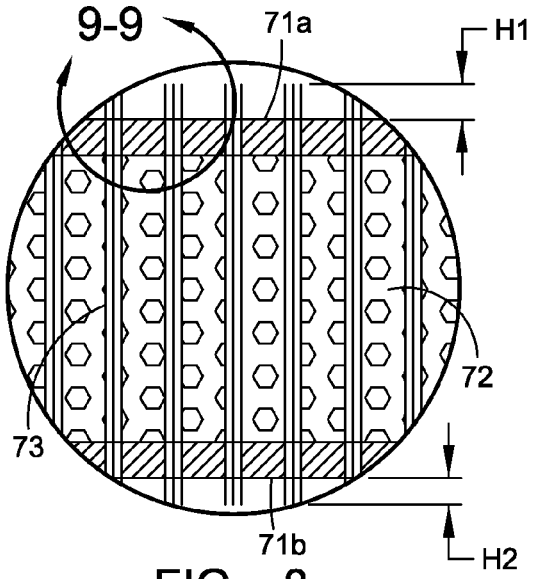
FIG. 8 is a magnified view taken along lines 8-8 of FIG. 7.
Figure 9:
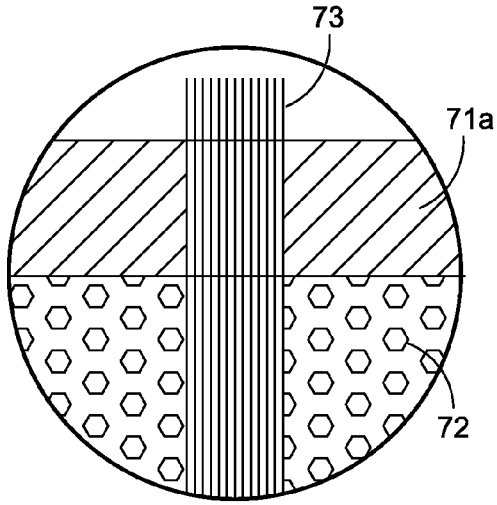
FIG. 9 is a magnified view taken along lines 9-9 of FIG. 8.

FIGS. 4, 5, and 6 show the runway matting material as it would be produced in the method and apparatus of FIG. 3. The schematic section 39 in FIG. 4 is fully cured as it would be leaving pultrusion die 26. Similar drawings of these same sections are shown for the preform of the runway matting material as it would look just prior to entering pultrusion die 26 by FIGS. 7, 8, and 9. FIGS. 7, 8 and 9 correlate with the preform 31 of FIG. 3. FIGS. 4, 5, and 6 correlate with the preform 32 and the part 33 of FIG. 3.

FIG. 7 schematically illustrates the entire matting panel 63 as a preform. The end of the panel 62 does not show the details 42 of FIG. 4 for clarity. The lines 8-8 indicate a magnified section that is shown in FIG. 8.

FIG. 8 shows the skins 71*a* and 71*b*, the core 72 and the 3-D groupings of Z-axis fiber filaments 73. One can see the egressing of the fiber filaments above and below skins 71*a* and 71*b* by a distance H1 and H2, respectively. The lines 9-9 indicate a further magnification which is illustrated in FIG. 9.

FIG. 9 shows the preform with the core 72 and upper skin material 71*a* and a single group of Z-axis fiber filaments 73. Note the egressed position of the fiber filaments, which after entering the pultrusion die will be bent over and riveted, or clinched, to the composite skin. Because the skins 71*a* and 71*b* are made of X-Y material and the grouping of fiber filaments are in the normal direction to X-Y, or the Z-direction, the composite skin in the region of the 3-D grouping of fiber filaments is said to be a three dimensional composite.

Figure 10:
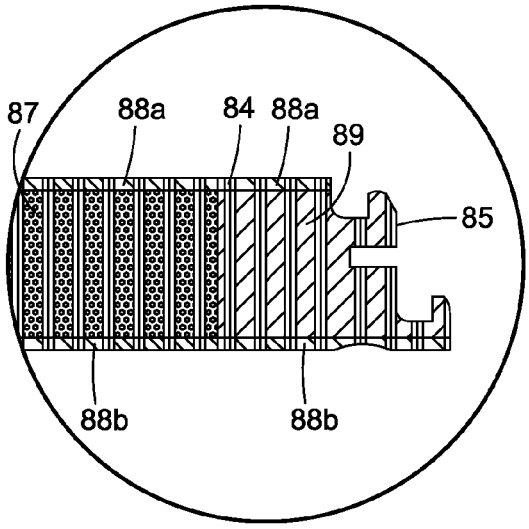
FIG. 10 is a magnified view taken along lines 10-10 of FIG. 4.

FIG. 10 is a magnified view taken along lines 10-10 of FIG. 4 and schematically depicts a core material 87, a skin material 88*a* and 88*b* and a new interior composite material 89. As stated this material 89 would consist of X-Y fiber material that is the same as the skin material 88*a* and 88*b* but is narrow in width, say 2 to 3 inches wide in this matting embodiment. The 3-D groupings of Z-axis fiber filaments 84 are deposited by the Z-axis deposition machine 24 in FIG. 3, and are operated independent of the density of the material. The 3-D groupings of fiber Z-axis filaments can be easily deposited through either the core material 87 or the higher density X-Y material 89. The interlocking connecting joint 85 can be either machined into the shape of 85 in FIG. 10 or can be pultruded and shaped by the pultrusion die. In FIG. 10 joint 85 is machined. If it were pultruded, the 3-D groupings of Z-axis fiber filaments in 85 would show riveted or clinched ends. Clearly other interlocking joints or overlaps could be used to connect matting panels. Alternatively, in other applications, the 3-D fiber composite structure panel does not include interlocking joints.

With reference to FIGS. 11-20, another embodiment of a composite laminate reinforced with curvilinear fiber and exemplary method of making the same will be described.

Figure 11:
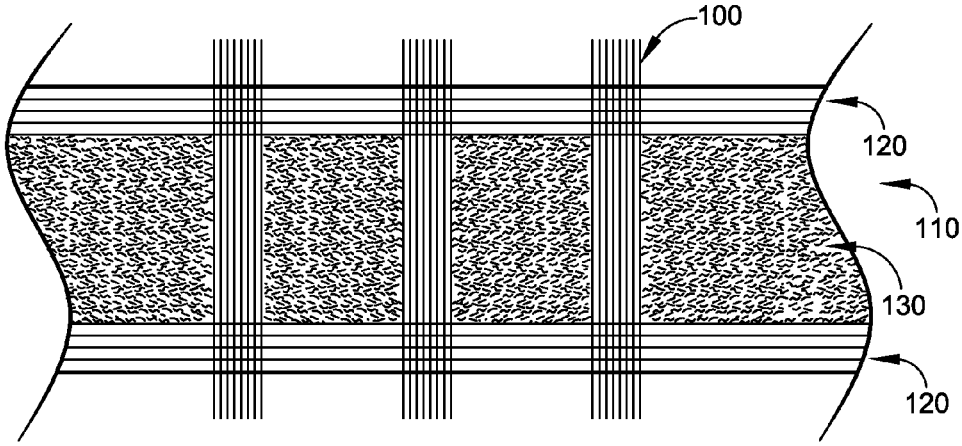
FIG. 11 is a cross-sectional view of an embodiment of a 3-D Z-axis reinforced composite laminate structure prior to resin impregnation.

FIG. 11 illustrates a series of discrete bundles of 3-D fibers 100 deposited in a sandwich structure 110, which may include face sheet material, face sheet, or skin material 120 on outsides of the sandwich structure 110 and an interior core material 130, prior to resin impregnation and catalyzation. The 3-D fiber bundles 100 may be deposited in the same manner as the fiber bundles 73 described above. The 3-D fiber bundles 100 illustrated in FIG. 11 are "virgin" fiber in that the fiber bundles 100 have not been exposed to resin, and, therefore have no significant stiffness or rigidity. In the prior art, cured or rigid pins have been used to deposit 3-D reinforcement into a composite sandwich; however, the bonds later formed in the cured composite sandwich have secondary bonds with the rigid 3-D pins. These secondary bonds form relatively weak joints.

Figure 12:
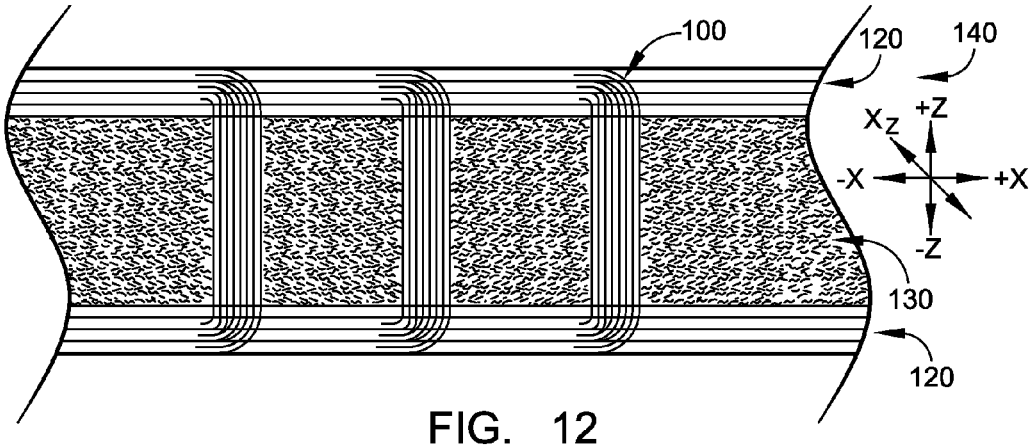
FIG. 12 is a cross-sectional view of an embodiment of a co-cured composite laminate structure reinforced with curvilinear 3-D fiber bundles.

In accordance with an embodiment of the invention, FIG. 12 illustrates a cured composite laminate 140 reinforced with curvilinear fiber bundles 100. The fiber bundles 100 are co-cured with the X-Y fibrous layers of the face sheet material 120 so that primary bonds occur between the 3-D fiber bundles 100 and the X-Y fibrous layers of the face sheet material 120. These primary bonds make the 3-D fiber-reinforced composite laminate 140 significantly stronger than the 3-D pin-reinforced composite laminates of the prior art. The curvilinear nature of the fiber bundles 100 in the face sheet material 120 also provides structural advantages in the composite laminate 140 that will be discussed in more detail farther below.

Figure 13:
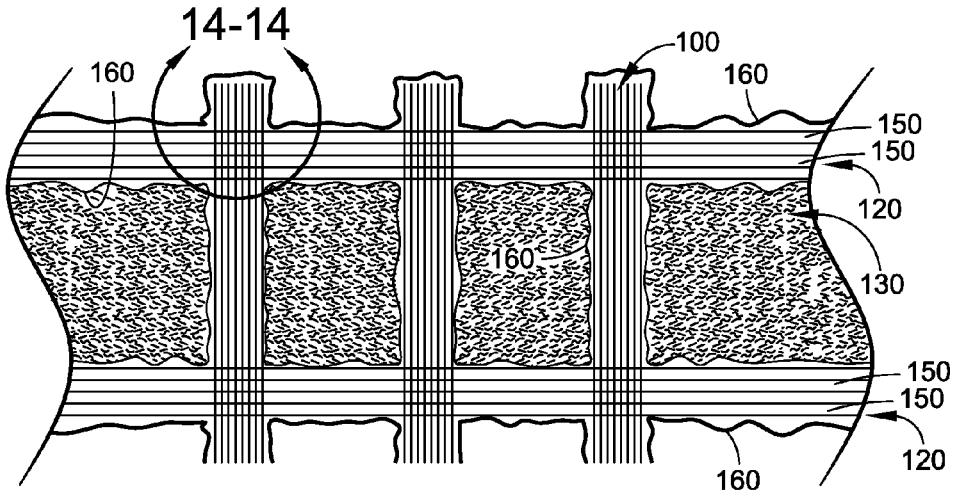
FIG. 13 is a cross-sectional view of the 3-D Z-axis reinforced composite laminate structure of FIG. 12 after resin impregnation.

FIG. 13 shows the 3-D fiber bundles 100 in the sandwich structure 110 prior to processing. Within the face sheet material 120 are individual ply layers 150. FIG. 13 also shows resin 160 that has impregnated the sandwich structure 110 and fiber bundles 100. Resin 160 migrates bi-directionally, in both directions, along the length of the fiber bundles 100 through capillary action to impregnate the fiber bundles 100 and the sections of the ply layers 150.

Figure 14:
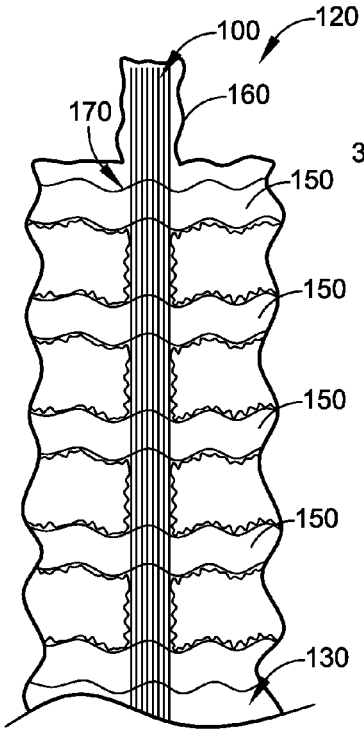
FIG. 14 is an enlarged cross-sectional view of the 3-D Z-axis reinforced composite laminate structure of FIG. 13 taken in section 14 of FIG. 13.

FIG. 14 shows an enlarged cross-sectional view of the multiple ply layers or X-Y material layers 150 in the upper face sheet material 120 with one of the 3-D fiber bundles 100 extending from the interior core material 130 to a distance above the upper face sheet material 120. The multiple ply layers 150 and the 3-D fiber bundle 100 is shown impregnated with the resin 160. Although the ply layers 150 are shown separated by a space filled with resin 160, it should be noted that in reality no space may exist or the space may be very small because the layers 150 may be in contact with each other or the layers 150 may be separated by a very thin layer of resin 160. The 3-D fiber bundle 100 is not rigid and is generally straight through all of the ply layers 150 in the Z direction prior to co-curing and after the 3-D fiber bundle insertion process. After the 3-D fiber bundle 100 has been inserted through the interior core material 130 and the ply layers 150, each ply layer 150 closes around the perimeter of the 3-D fiber bundle 100. This creates an intimate contact point or area 170 between the perimeter of the 3-D fiber bundle 100 and its intersection with each ply layer 150 due to the spring characteristics of the ply layers 150. These contact points or areas 170 occur everywhere the 3-D fiber bundles 100 intersect with each ply layer 150.

With reference to FIGS. 15-18, the pultrusion process for creating a composite laminate 140 reinforced with curvilinear fiber 100 (cured, co-cured, and primary-bond-cured sandwich structure) as shown in FIG. 12 from the wetted-out, uncured, sandwich structure 110 of FIGS. 13, 14 will now be described.

Figure 15:
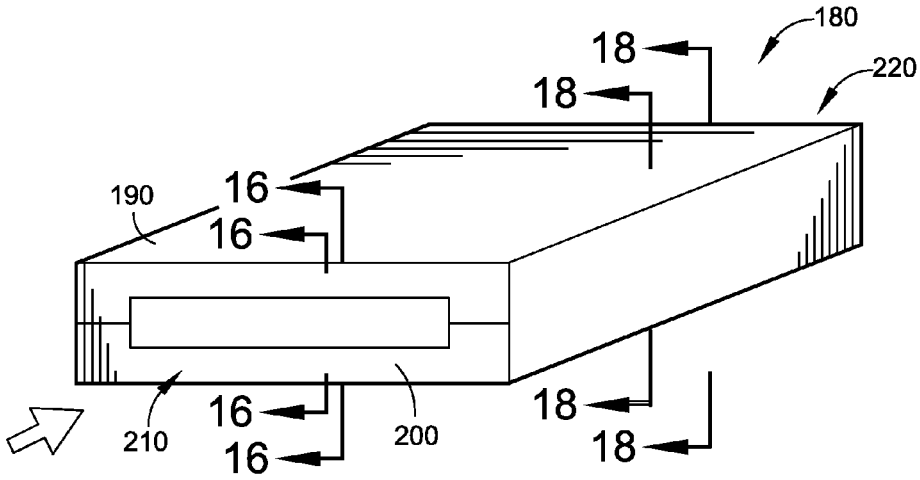
FIG. 15 is a perspective view of an embodiment of a pultrusion die that may be used to perform the exemplary pultrusion process described herein.

FIG. 15 shows a perspective view of an embodiment of a pultrusion die 180 used to create the composite laminate 140 and co-cured, clinched curvilinear fibers 100 shown in FIG. 12. The die 180 includes a top die member 190, a bottom die member 200, a die entrance 210, and a die exit 220. The preform 31 enters the die entrance 210 in the direction of the arrow shown.

Figure 16:
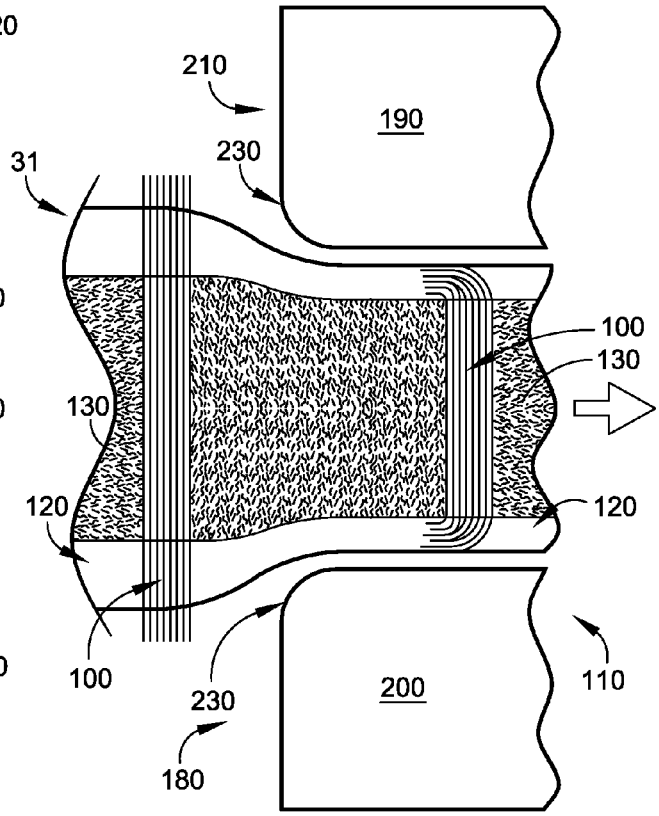
FIG. 16 is a cross-sectional view of an embodiment of a die entrance of the pultrusion die illustrated in FIG. 15 and shows an embodiment of a wetted-out preform panel of the 3-D Z-axis reinforced composite laminate structure as it is pulled into the pultrusion die.

FIG. 16 shows the process occurring at the die entrance 210. The wetted-out preform 31 is pulled into the pultrusion die 180 by the grippers 34, 35 in the direction of the arrow shown. The top die member 190 and the bottom die member 200 each include a curved edge or standard inlet radius 230 at the die entrance 210 to facilitate the pultrusion process. Each radius 230 facilitates the clinching process described above and causes the 3-D fiber bundles 100 to take on a curvilinear shape in the ply layers 150 of the upper and lower face sheet materials 120.

The distance between the top die member 190 and the bottom die member 200 is less than the thickness of the preform 31. As a result, as the preform 31 is pulled into the pultrusion die 180, the sandwich structure 110 is compressed. For example, a 3.100 inch, wetted-out preform 31 may be compressed to 3.000 inches within the pultrusion die 180.

This compression assists with squeeze-out of excess resin and with forming the 3-D fiber bundle 100 into the curvilinear shape.

It should be noted that in the condition shown in FIG. 16, the curvilinear 3-D fiber bundle 100 and the face sheet material 120 are not cured. The co-curing and primary bonding may occur approximately one-half to two-thirds of the way through the die 180, depending on factors such as, but not limited to, line speed, temperature zones, and resin chemistry.

Figure 17:
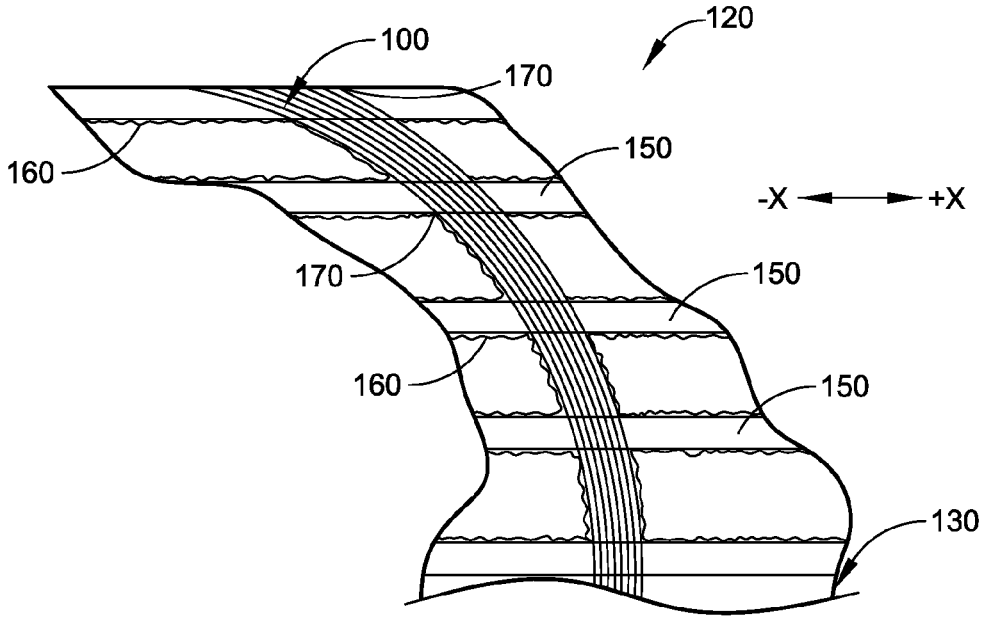
FIG. 17 is an enlarged cross-sectional view, similar to FIG. 14, of the 3-D Z-axis reinforced composite laminate structure as it is pulled into the pultrusion die.

With reference to FIG. 17, a more detailed explanation of the changes that occur with the 3-D fiber bundles 100 and the sandwich structure 110 as the wetted-out preform 31 is pulled into the pultrusion die 180 will be described. As the sandwich structure 110 is pulled into the pultrusion die 180, the ply layers 150 slip with respect to each other in the X direction because the bulk of the fibers in each 3-D fiber bundle 100 resist being bent at right angles (bending of the fibers at right angles would cause the fibers to fracture); frictional forces in the pultrusion die 180 allow the outermost ply layers 150 (those layers 150 closest to the die 180) to slip in the X-direction as the 3-D fiber bundle 100 is gradually changed to a curvilinear shape; the wetted-out ply layers 150 easily slip relative to each other, due to low friction between ply layers 150 caused by fully wetted out resin 160 in between each ply layer 150; and the clinching of multiple numbers of 3-D fiber bundles 100 into the face sheet material 120 provides a significant X-directional force over the entire width of the sandwich panel being processed. There is a progressive movement of the ply layers 150 in the X direction that progressively increases from the innermost ply layers 150 to the outermost ply layers 150. Because of the nature of the intimate contact points or areas 170, the 3-D fiber bundle 100 is formed into the curvilinear path shown in FIG. 17.

The curvilinear shape of the 3-D fiber bundle 100 taken on in the ply layers 150 of the face sheet materials 120 as the wetted-out preform 31 is pulled into the pultrusion die 180 causes the 3-D fiber bundle 100 to be pulled in opposite directions where the 3-D fiber bundle 100 enters the ply layers 150 on the top and bottom of the interior core material 130, placing the 3-D fiber material in tension. Placing the 3-D fiber bundle 100 in tension prior to co-curing causes the 3-D fiber bundle 100 to be maintained in a generally straight condition in the interior core material 130 prior to and during co-curing. This maximizes the strength properties of the composite material.

Figure 18:
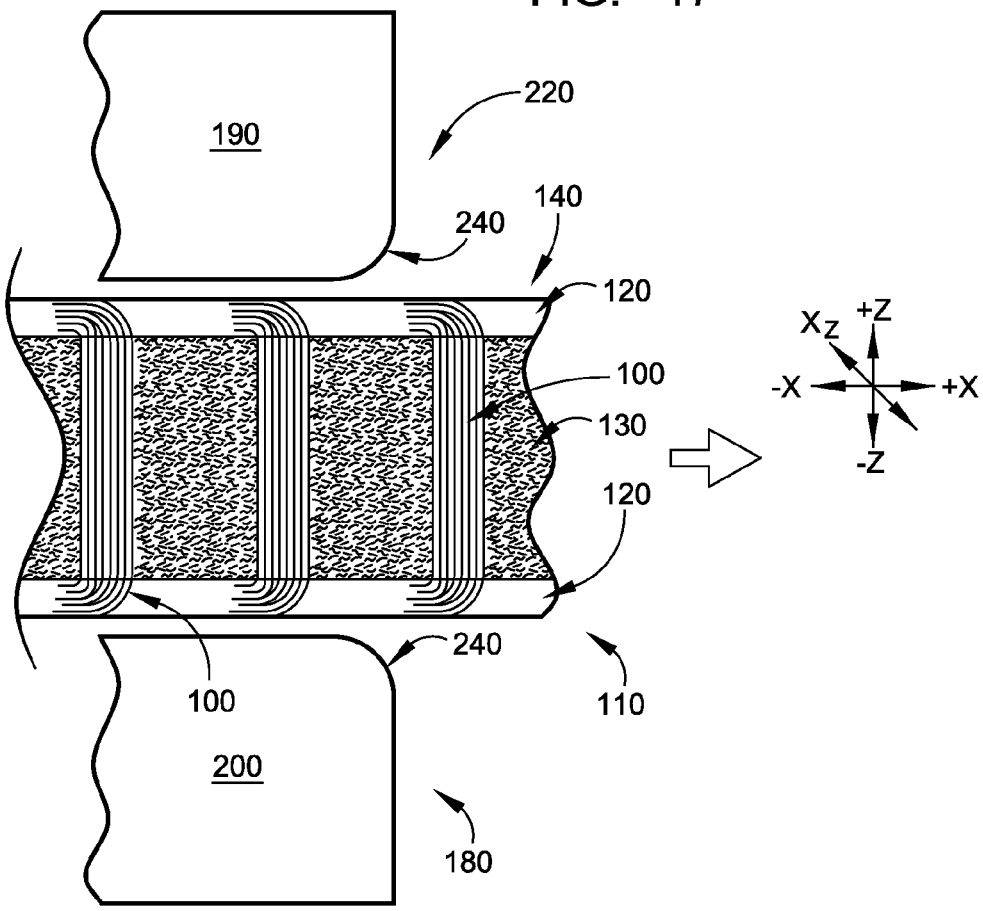
FIG. 18 is a cross-sectional view of an embodiment of a die exit of the pultrusion die illustrated in FIG. 15 and shows an embodiment of a co-cured composite laminate panel reinforced with curvilinear fiber bundles as it is pulled out of the pultrusion die.

FIG. 18 shows the process occurring at the die exit 220 after curing. A section of a sandwich structure 110 of a completely cured composite laminate panel 140 reinforced with curvilinear fiber bundles 100 is shown exiting the die exit 220 in the direction of the arrow shown. The top die member 190 and the bottom die member 200 of the die exit 220 each include a curved edge or outlet radius 240 that is advantageous to the smooth exit of the cured composite laminate panel 140 from the pultrusion die 180. Because the sandwich structure 110 is completely cured, the sandwich structure 110 does not expand beyond the distance between the top die member 190 and the bottom die member 200 when exiting the pultrusion die 180.

The sandwich structure 110 exiting the pultrusion die 180 has 3-D fiber bundles that are discrete and are generally Z-directional through the core material 130, are Z-X directional through the face sheet material 120, and are X-directional in the outermost layer of the face sheet material 120, being clinched and fully integrated into this outermost layer.

With reference to FIG. 12, the completely cured composite laminate panel 140 reinforced with curvilinear fiber bundles 100 has a primary bond between all 3-D fiber bundles 100 and face sheet material 120. The primary bond is a result of co-curing and is the highest order of bonding in composites, all fibers having received resin matrix material at the same time and having been cured at the same time. An examination of the skin properties of the composite laminate panel 140 illustrates the above.

The skin from a completely cured composite laminate panel 140 was separated from the rest of the panel and was tested in compression and tension in the X-direction and the Y-direction. The face sheet material was "balanced" in that it had the same quantity of 3-D fiber bundles 100 in the X-direction and the Y-direction. If the 3-D fiber bundles 100 were only Z-directional, they would not add to the tensile or compressive properties of the skin. If, however, the 3-D fiber bundle were Z, Z-X, and X directional as described above for the cured composite laminate panel 140, the tensile and compressive properties of the skin would be greater in the X-direction than the Y-direction.

The tensile and compressive properties measured for 4 different face sheet material samples are shown below in Tables 1 and 2, respectively. In Samples 1 and 2, Ultimate Tensile Stress and Ultimate Compression Stress measurements were taken only in the X Direction. In Samples 3 and 4, Ultimate Tensile Stress and Ultimate Compression Stress measurements were taken only in the Y Direction.

TABLE 1

| Ultimate Tensile Stress | X-Direction | Y-Direction |
|---|---|---|
| Sample 1 | 41,293 psi | |
| Sample 2 | 44,482 psi | |
| Sample 3 | | 35,023 psi |
| Sample 4 | | 37,639 psi |

TABLE 2

| Ultimate Compressive Stress | X-Direction | Y-Direction |
|---|---|---|
| Sample 1 | 35,960 psi | |
| Sample 2 | 33,948 psi | |
| Sample 3 | | 20,403 psi |
| Sample 4 | | 23,009 psi |

It is important to note that the measured compressive stress was generally lower than the measured tensile stress for the samples. However, as evidenced by Tables 1 and 2, clearly the addition of the Z-X and X-directional reinforcement added to the strength properties in the X-direction. If not for the curvilinear fiber bundles 100 in the Z-X and X directions, the X and Y properties would have been approximately the same. This shows that the 3-D fiber bundles 100 are fully integrated and co-cured with the face sheet materials 120.

A multitude of 3-D fiber bundles 100 may be inserted into a sandwich panel over a very large area. For example, the applicants have produced a pultruded sandwich panel that is 2.0 inches thick, 38 inches wide, and 50 feet long. With 0.25 inch spacing, this results in 2,304 3-D fiber bundles 100 per square foot. Each fiber bundle 100 is formed in the same manner. As a result, each of the 2,304 3-D fiber bundles 100 adds to the strength of the X direction of the face sheet materials 120. The Z-directional characteristics of the 3-D fiber bundles 100 through the interior core material 130 adds considerably to the Z-direction properties, among other properties, of the entire sandwich structure. The difference in compressive strengths of the sandwich structure in the Z-direction can increase from 30 psi to 2,500 psi. Thus, the 3-D fiber bundles, being curvilinear components of the solid composite structure add to the X-directional, Z-X directional, and Z-directional properties of the finished structure.

Figure 19:
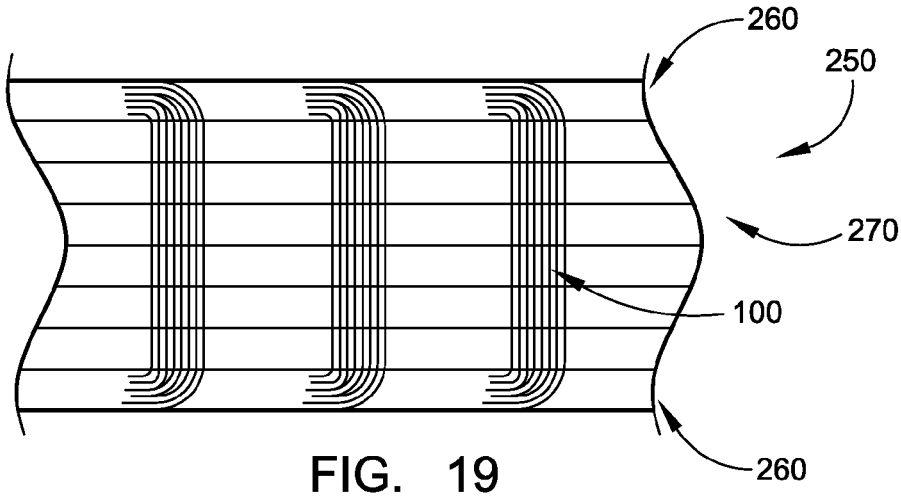
FIG. 19 is a cross-sectional view of another embodiment of a co-cured composite laminate structure reinforced with curvilinear 3-D fiber bundles.

FIG. 19 illustrates a cured composite laminate 250 reinforced with curvilinear fiber bundles 100 similar to the cured composite laminate 250 described above with respect to FIGS. 11-18, except the interior core material 130 is replaced by additional ply layers 150. The layers 150 may be the same or one or more of the layers 150 may be different. The cured composite laminate 250 may also be referred to as a composite laminate that is 3-dimensional and solid. The 3-D fiber bundles 100 are curvilinear in outer layers 260 and are generally straight in the Z-direction through a central section of layers 270 of the solid composite. Thus, progressing from the central section outwards, transition of the 3-D fiber bundles 100 occurs from a Z-direction to a Z-X direction and then to a X-direction in the solid composite laminate.

Figure 20:
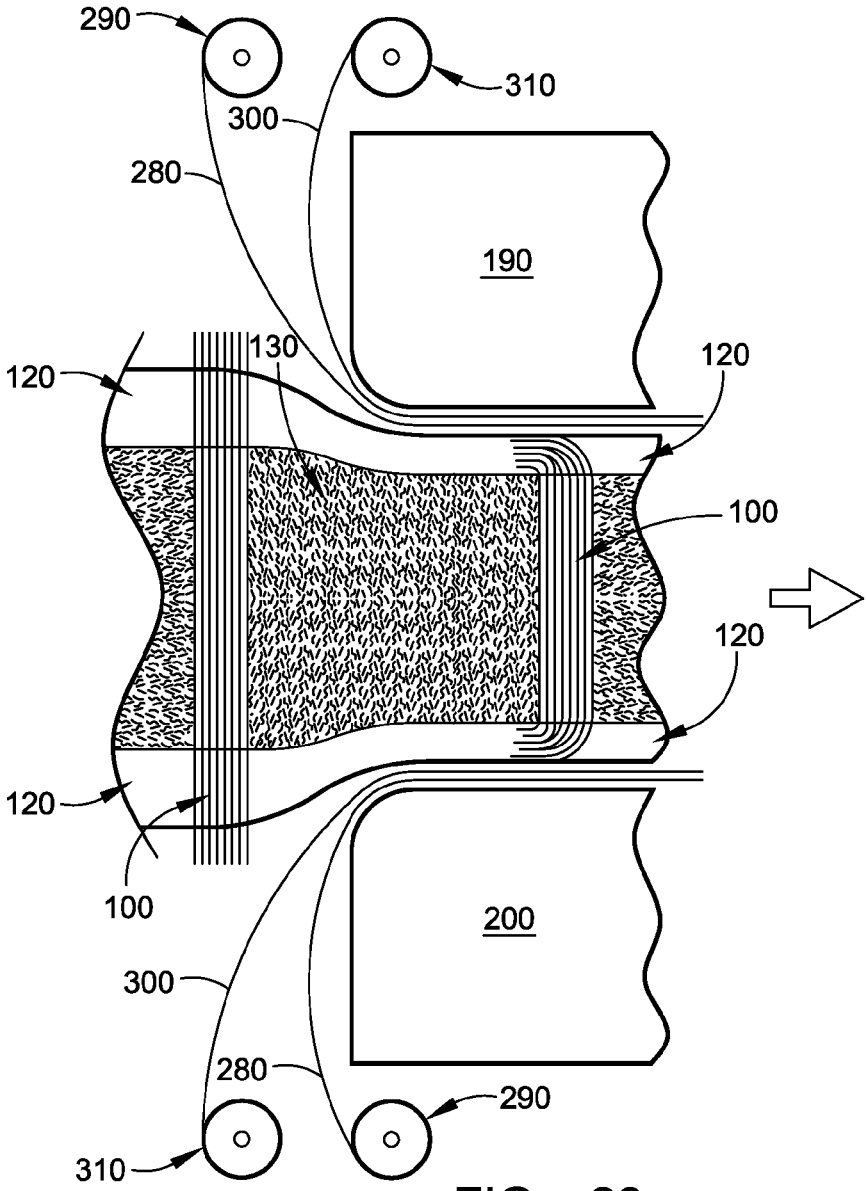
FIG. 20 is a cross-sectional view, similar to FIG. 16, of the die entrance of the pultrusion die illustrated in FIG. 15 and shows an alternative exemplary process where one or more additional layers are added to the face sheet material of a wetted-out preform panel of the 3-D Z-axis reinforced composite laminate structure as it is pulled into the pultrusion die.

FIG. 20 shows an alternative process of pultrusion that is the same as that described above with respect to FIGS. 15-18, except that one or more additional layers may be added onto the face sheet material 120 for the pultrusion process. In the embodiment shown, reinforcement material layer 280 from reinforcement material rolls 290 may be added on the face sheet material 120 as the wetted-out preform 31 is pulled into the pultrusion die 180 in the direction of the arrow shown. The reinforcement material layer 280 may be reinforcements of continuous strand mat ("CSM") or the like added to the final pultrusion to give a very even, aesthetic, appearance to the final pultruded surface finish as well as adding X-directional, Y-directional, and X-Y directional properties to the face sheet material 120. Because the 3-D fiber bundles 100 are slightly underneath the reinforcement material layer 280 as it is being formed in the pultrusion die 180 and because random swirling may occur in the reinforcement material layer 280, the discrete ends of some of the 3-D fiber bundles 100 may intermingle with the reinforcement material layer 280 while the discrete ends of other 3-D fiber bundles 100 become fully integrated into the outermost layer of the face sheet material 120. Thus, the 3-D fiber bundles may become part of the face sheet material 110 and part of the reinforcement material layer 280 so that the X-directional component from the 3-D fiber bundles 100 may be partially integrated with the reinforcement material layer 280 and the outermost layers of face sheet material 110.

Similarly, a veil material layer 300 from veil material rolls 310 may be added on the reinforcement material layer 280 as the wetted-out preform 31 is pulled into the pultrusion die 180. The veil material layer 300 may be made of a polyester veil material generally used to protect the cured composite laminate 140 from UV rays and to provide a final aesthetic surface to the pultruded profile. Example types of polyester veil material that maybe used are sold under the brand names Remay and Nexus.

It should be noted, similar to that with the pultrusion process of FIG. 16, there is a compression of the preform 31 as it enters the pultrusion die 180. This aids consolidation and helps squeeze excess resin, which generally drips off the die entrance 210. Because of this, there is generally enough excess resin carried into the pultrusion die 180 to fully wet out the additional materials layers 280, 300.

Figure 21:
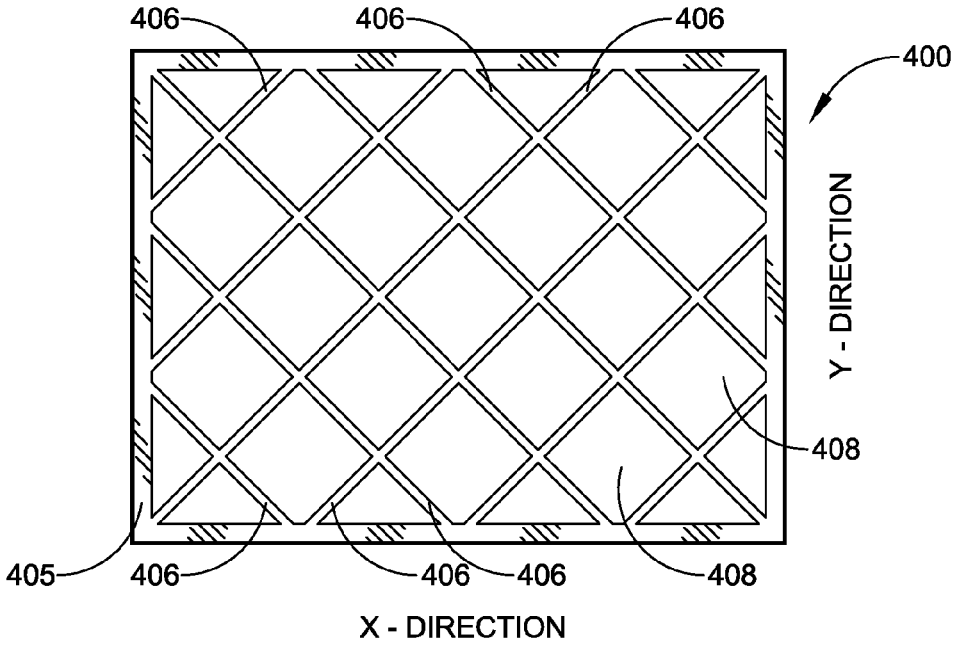
FIG. 21 is a top plan view of an embodiment of an improved composite sandwich panel.
Figure 22:
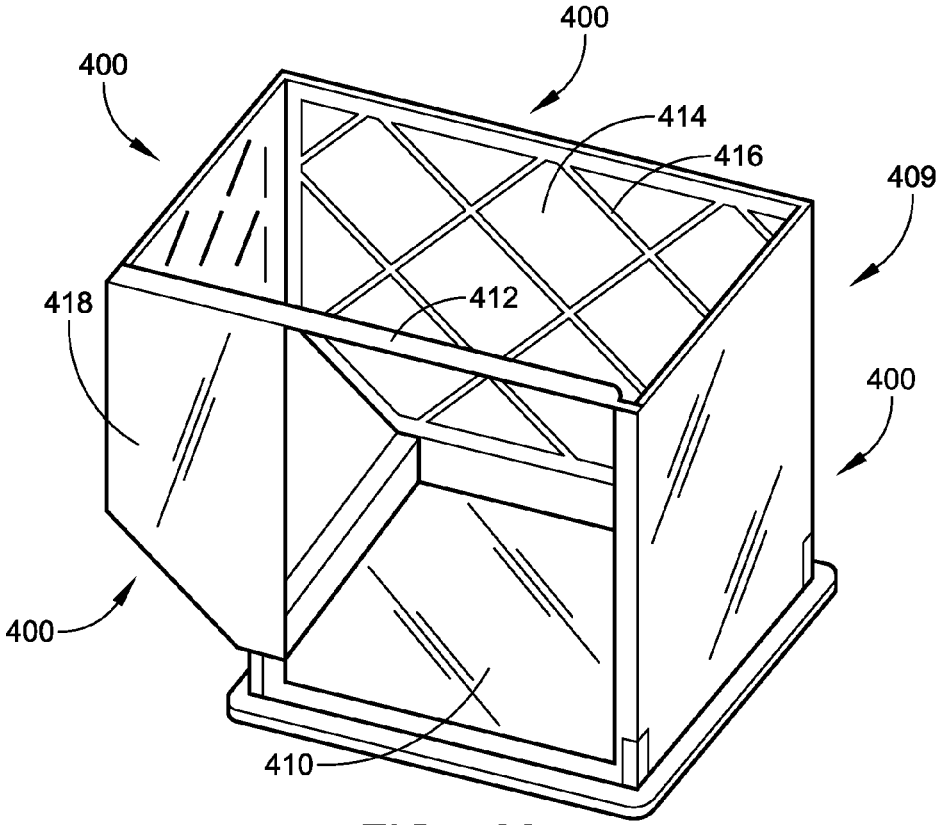
FIG. 22 is a perspective view of an embodiment of an air transportation Unit Load Device (ULD).

With reference to FIGS. 21 and 22, an improved composite sandwich panel 400 and second step in the method of making the improved composite sandwich panel 400 will now be described.

Second Step—Machining Operation Performed on One Side of the 3D-Fiber Sandwich Panel The first step of the manufacturing process involves the manufacturing of a new sandwich panel which has been described above with respect to FIGS. 1-20. The sandwich panel, as disclosed by the above, is a new construction in which 3D-fibers are deposited and integrated into the skins of the sandwich. This sandwich panel construction eliminates skin delamination, one of the common failure modes of composite sandwich panels.

In the second step, a machining operation is performed on one side of the 3D-fiber sandwich panel manufactured by the first step described above with respect to FIGS. 1-20. This second step would not make design-sense, but for the existence of the 3D-reinforced sandwich panel described above with respect to FIGS. 1-20.

The panel manufactured by the first step described above with respect to FIGS. 1-20 is placed on a CNC machining table, mechanically-clamped, or vacuum-clamped, and is machined in a pattern that allows substantially 70% of the weight of the one skin and 70% of the core to be removed, without severely compromising the structural integrity of the sandwich panel. The pattern could be any of an infinite variety of machining combinations.

FIG. 21 shows a plan view of one of these machining combinations with the back skin side facing down. This is a flat panel 400 that might be used, for example, but not by way of limitation, in a transportation product such as, but not limited to, the wall of a trailer, the floor of a rail-car or airplane, or the wall of an air cargo container. In an embodiment, the panel 400 of FIG. 21 is ½ inch thick or 1.0 inches thick, or any other thickness. The view shown in FIG. 21 is a plan view (i.e., looking normal to the panel surface, looking in the z-direction). The x-direction and y-direction are defined in the figure.

The base panel before machining is indicated by reference number 405 in the figure. At this location, the base panel 405 has two or more skins, a core material and 3D fibers in the Z-axis integrated to both skins and transitioning through the core. Structural stringers 406 are created by removing the top-most-skin and substantially all of the core and the 3D fiber down to the back skin. The remaining parent material forms the stringers 406. The stringers 406 are shown running +and −45 degrees relative to at least one of the sides and ends and in fact have the original sandwich material of two or more skins and the core material and the 3D-fibers running in the z-axis and integrated into all skins. Recesses 408 are formed by the removal of the top-most skin and substantially all of the core and the 3D fiber down to the back skin. On one side of the panel 400, as shown in FIG. 21, the stringers 406 and recesses 408 form a honeycombed pattern. On an opposite side of the panel 400, the far-side skin is undisturbed and has a uniform solid appearance (i.e., no holes, recesses). In effect, the stringers 406 are integrated into the far-side skin by way of the remaining z-axis 3D fibers.

The sandwich material can have a core material such as, but not limited to, polyisocyanurate foam or balsa wood or any of the cores previously cited. The skins, likewise, can be any composite skin previously cited, such as, but not limited to, glass, carbon, aramid or Spectra, or high-strength PE, and the matrix of the skin can be thermoset or thermoplastic material. The 3D fibers can also be of any of the above materials and matrices and can be in any density of fiber bundles per square plan form area. Likewise the machining of the recess 408 can be right down to the inside surface of the back skin, or, alternately, can be machined to just slightly away from the inside surface of the back skin, leaving some core material and some 3D-fiber stubble attached to the back skin in recess 408. 3D fiber stubble is the remaining integrated 3D fibers in the back skin.

For the purpose of clarity, if the panel 400 of FIG. 21 has a 0.500 inch sandwich thickness with 0.025 inch skins and 2 fibers per square inch 3D-fibers insertion density, then by machining to a depth (on a CNC mill) into the base panel 405 of 0.475 inches in the region 408 of FIG. 21, then the recess 408 would have the core completely removed, yet the back skin at 0.025 inches would be fully in tact. If, however, the machining went to a depth of 0.465 inches, then the back skin would be fully in tact and there would remain 0.010 inches of core material and 3D fiber stubble in the region 408 of FIG. 21.

It is advantageous for the front skin composite material in the X-Y plane to have a significant number of +and −45 degree fiber elements running in the same +and −45 degree directions as the stringers 406 so that, after the machining step (which cuts through the front skin), the undisturbed sandwich material at the interior, which forms the resultant stringers 406, have substantial compressive and tensile properties since they have not been substantially cut. Testing has proven that the panel 400 benefits from these fibers in the X-Y plane, defined by the front skin, being oriented in this fiber orientation. If the front skin grid is machined at +and −45 degrees as shown, then the fibers in the X-Y plane of the front skin should be oriented this way also. Similarly, if the front skin grid is machined at angles other than +and −45 degrees, then the fibers in the X-Y plane of the front skin should be oriented this way also.

The creation of this new integrated-skin/stringer sandwich panel 400 is a very useful invention and an improvement over the current sandwich-panel art. Any attempt to perform this operation on a traditional sandwich panel would result in early failure of the sandwich stringers because traditional skin delamination would be accelerated with such reduced skin area as evident by the front skin, once machined, of FIG. 21. Traditionally, delamination in sandwich materials depends on the bond of the skin to the core, which is directly proportional to the bond area. By reducing the effective area by as much as 70%, as shown in FIG. 21, very rapid delamination would occur in a traditional sandwich panel after machining a panel having no delamination features such as the 3D fibers mentioned above.

If, for example, the panel 400 is used as a floor panel where the machined stringers 406 are at the bottom of the floor and the back surface-skin of FIG. 21 is oriented upward, the panel 400 would be very good in bending and flexural strength. Any downward load applied to the floor panel would place the full surface side (referred to as the back skin in FIG. 21) in compression and the 3D-fibers of the stringer side in tension. Since composite fibers are stronger in tension than compression, the reduced area of the stringer side could be tailored in areas, such that the failure of the top solid surface or the stringers would be close to the same ultimate bending load.

Having described this panel 400 as a weight saving product for transportation applications, in an alternative embodiment, the core material that remains inside the stringers 406 of FIG. 21 is removed. In this embodiment, assuming panel 400 is 60×60 inches long/wide and 0.500 inches thick, an additional 2-3 lbs. could be removed from the panel 400 if the core material that remains inside the stringers 406 of FIG. 21 is removed. The core material that remains inside the stringers 406 of FIG. 21 is removed by water-blasting, sand-blasting, or chemical treating of the core material (e.g., foam) from the interior of the stringers 406, leaving only the 3D fiber bundles holding the stringers 406 to the back skin of FIG. 21. The inventor(s) have recognized that the core provides very little, if any benefit, to a 3D-fiber reinforced sandwich structure, so it remains important to reduce weight wherever possible. The value of one pound of weight savings, for example, in a Boeing 747-400 aircraft over 5 years is calculated as $420, based upon high altitude cruise and long-range flights (12 hours). Therefore, reducing the weight of an already vastly improved sandwich panel by removing the foam material is a high-value manufacturing step.

One can quickly see that a traditional sandwich panel (with no integrated 3D fibers) could not possibly be considered viable as a machined panel, as in FIG. 21, with the core material removed. This is because, with the core material removed, the stringers 406 of FIG. 21 would not be held in place by any material and would simply fall away after sand-blasting the core material. The instant invention, however would not have the same result since the primary through-thickness load caring members, the 3D fiber bundles, remain in tact.

FIG. 22 shows a Unit Load Device (ULD) 409, the standard container defined by the FAA and the International Air Transport Association (IATA). It is the standardized container designed to carry cargo in the lower deck of all wide-bodied jets. The top of the ULD 409 is shown with the top removed in FIG. 22 for clarity.

The ULD 409 includes a floor 410 and wall panels 400 joined with edges 412. The edges 412 can be made from a variety of lightweight materials including, but not limited to, aluminum or composite pultrusions. The wall panels 400 are machined panels similar to panel 400 described above with respect to FIG. 21. Each panel 400 includes recesses 414 similar to recesses 408 in FIG. 21, stringers 416 similar to stringers 406 in FIG. 21, and an outside-facing back skin 418, which is the remaining contiguous side after machining, similar to back skin described above. The top panel and/or the floor 410 may have the same construction as the panels 400.

The value of one pound of weight savings on a Boeing 747-400 at high altitude and long-range cruise has been discussed above. The ULD 409 with top panel and fully assembled weighs 53 lbs. less than the typical ULD of the same size (usually made from aluminum). With thirty (30) ULDs in a Boeing 747-400 and 53 lbs. savings per ULD, at $70 per barrel oil and $2.20 per gallon jet fuel, an air cargo company can save $133,000 per year per aircraft. A bulk of this 53 lb. savings comes from using the two-step machined panel and method of manufacturing. First, the composite panel is made from a 3D panel process incorporating 3D connecting and integrated fibers. Second, the stringer configuration is incorporated, similar to FIG. 21, and the weight is significantly reduced for very little reduction in strength.

Without limiting the scope of applications, this panel 400 can be used in a myriad of applications within the transportation industries and other industries. Many other panel applications will become apparent where weight is critical.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A composite panel, comprising:

a first skin;

a second skin;

a core;

and a plurality of distinct groupings of Z-axis fibers that extend through the core from the first skin to the second skin, the Z-axis fibers including opposite ends respectively terminating at and integrated into the first skin and the second skin, wherein the plurality of distinct groupings of Z-axis fibers form structural stringers and recesses in the composite panel, the structural stringers formed by absence of second skin other than areas where the Z-axis fibers terminate at and are integrated into the second skin and absence of substantially all of the core other than areas of the Z-axis fibers.

2. The composite panel of claim 1, wherein the panel includes sides and ends, and the structural stringers are oriented at substantially forty five (45) degrees relative to at least one of the sides and ends.

3. The composite panel of claim 1, wherein the structural stringers and recesses in the composite panel have a honeycombed pattern.

4. The composite panel of claim 1, wherein the core is at least one of polyisocyanurate foam, urethane foam, PVC foam, phenolic foam, balsa wood, X-Y fiber material, and a combination of X-Y fiber material and other core material.

5. The composite panel of claim 1, wherein the first skin is at least one of glass fiber, carbon fiber, aramid fiber, spectra, X-Y stitched fabric, woven roving and a high-strength PE.

6. The composite panel of claim 1, wherein the structural stringers extend substantially perpendicularly from the first skin.

7. The composite panel of claim 1, wherein the panel is configured so that a downward load applied to the panel with the first skin faced up places first skin in compression and the Z-axis fibers in tension.

8. The composite panel of claim 1, wherein the Z-axis fibers are co-cured and primary bonded with the first skin.

9. An air cargo container for carrying cargo in the lower deck or upper deck of a wide-bodied airplane, comprising:

a floor, a top;

a plurality of wall panels joining the floor and the top, wherein one or more of the top, the floor and the wall panels include a first skin, a second skin, and a core; and a plurality of distinct groupings of Z-axis fibers that extend through the core from the first skin to the second skin, the Z-axis fibers including opposite ends respectively terminating at and integrated into the first skin and the second skin, wherein the plurality of distinct groupings of Z-axis fibers form structural stringers and recesses, the structural stringers formed by absence of second skin other than areas where the Z-axis fibers terminate at and are integrated into the second skin and absence of substantially all of the core other than areas of the Z-axis fibers.

10. The air cargo container of claim 9, wherein one or more of the top, the floor and the wall panels include sides and ends, and the structural stringers are oriented at substantially forty five (45) degrees relative to at least one of the sides and ends.

11. The air cargo container of claim 9, wherein the structural stringers and recesses have a honeycombed pattern.

12. The air cargo container of claim 9, wherein the core is at least one of polyisocyanurate foam, urethane foam, PVC foam, phenolic foam, balsa wood, X-Y fiber material, and a combination of X-Y fiber material and other core material.

13. The air cargo container of claim 9, wherein the first skin is at least one of glass fiber, carbon fiber, aramid fiber, spectra, X-Y stitched fabric, woven roving and a high-strength PE.

14. The air cargo container of claim 9, wherein the structural stringers extend substantially perpendicularly from the first skin.

15. The air cargo container of claim 9, wherein a load applied substantially perpendicularly to the first skin places the first skin in compression and the Z-axis fibers in tension.

16. The air cargo container of claim 9, wherein the Z-axis fibers are co-cured and primary bonded with the first skin.

17. A composite panel, comprising:

a first skin;

a second skin;

a core; and a plurality of distinct groupings of Z-axis fibers that extend through the core from the first skin to the second skin, the Z-axis fibers including opposite ends respectively terminating at and integrated into the first skin and the second skin, wherein the plurality of distinct groupings of Z-axis fibers form structural stringers and recesses in the composite panel, the structural stringers formed by absence of second skin other than areas where the Z-axis fibers terminate at and are integrated into the second skin and by absence of substantially all of the core in and around the Z-axis fibers.

* * * * *